United States Patent [19]

Sirel et al.

[11] 3,970,969

[45] July 20, 1976

[54] DEVICE FOR THE ELECTRICAL PROTECTION OF A COAXIAL CABLE BY TWO CONNECTED CIRCUITS

[75] Inventors: Michel Sirel; Francois Taille, both of Paris, France

[73] Assignee: Les Cables de Lyon, Lyon Cedex, France

[22] Filed: Dec. 13, 1974

[21] Appl. No.: 532,482

[30] Foreign Application Priority Data

Dec. 18, 1973 France ..... 73.45204

[52] U.S. Cl. ..... 333/12; 333/97 R

[51] Int. Cl.[2] ..... H01P 1/00

[58] Field of Search ..... 333/12, 97 R

[56] References Cited

UNITED STATES PATENTS 2,376,101 5/1945 Tyzzer ..... 333/12

2,743,422 4/1956 Muchmore ..... 333/97 R

*Primary Examiner*—Paul L. Gensler

*Attorney, Agent, or Firm*—Haseltine, Lake & Waters

[57] ABSTRACT

A device is provided for the protection of a coaxial cable. In parallel to the coaxial cable is an equipotentiality circuit. Connected in series to the latter is a decoupling circuit. The decoupling circuit comprises a quarterwave line at each cut of the coaxial cable, the external line being open, whereas the decoupling circuit is incorporated in one of the branches of the T connection forming the equipotentiality circuit. The composite branch of the T connection is formed by means of a triple coaxial cable.

3 Claims, 6 Drawing Figures

DEVICE FOR THE ELECTRICAL PROTECTION OF A COAXIAL CABLE BY TWO CONNECTED CIRCUITS

The present invention relates to a device for the protection of connections by coaxial cables, for example, against the effects of electrical discharges of various origins, capable of producing interference signals in a frequency band lower than, for example, a few tenths of a kilocycle and relates more particularly to transmissions effected between an antenna and other equipment in the frequency band comprised between the limits, for example, of from one and a half to five hundred megacycles.

It is known to eliminate interference in the above band of transmission by means of a band filter and a tuned transformer. However, such circuits have the threefold disadvantage of having substantial attenuation, a relatively low pass band and a weight which is often considerable.

On the other hand, at hyperfrequencies, that is, above the order of a thousand megacycles, it is known to protect a coaxial line and its terminal equipment units by providing, on the one hand, a barrier for the very low frequency interference currents and, on the other hand, an equipotentiality of the two conductors of the line, to remove the effects of a contingent high-voltage direct current. These two safety measures are brought into effect by means of different circuits. The barrier or decoupling device for the very low frequency alternating currents and the low-voltage direct current is obtained for an interruption of the conductors. To insure, at high frequencies or micro-waves, the electrical continuity of the coaxial line, a trap or choke is inserted. That trap is formed by inserting in series with each cut of the two coaxial conductors, a low impedance auxiliary line having a length equal to the average operation half wavelength and whose end is short-circuited, thus avoiding radiation.

The equipotentiality device for the two coaxial conductors insures for the high-voltage direct current the protection of the terminal equipment units against discharges, preventing the discharge current from reaching them and being looped on the said conductors. For that purpose, the central conductor is connected to the external conductor of the coaxial line at a determined point. However, for the transmission of the useful signals, that is, at a clearly higher frequency than the very low interference frequency (a few tens of kilocycles), a coaxial line is arranged in parallel with the main line, the end of that line being short-circuited and its length being taken as equal to a quarter of the average operation wavelength.

For optimum operation, each of the lateral arms of the equipotentiality T connection thus formed has a length equal to a quarter of the wavelength and an impedance in the order of twenty percent less than that of the main coaxial line.

One of the objects of the present invention is to improve the devices for the protection of coaxial hyperfrequency transmission structures having decoupling and equipotentiality circuits to adapt the same to the branch of the lower frequency band previously defined and comprising that of the low and high frequencies.

For that purpose, it is sufficient to take, as the line forming the trap, a length equal to a quarter of the length of the wave to be transmitted and to leave it open. Indeed, at these frequencies, the impedance of an open circuit is very high even if that of the line is an appreciable fraction (10 or so ohms) of that of the main line (in the order of 50 or so ohms). In fact, the said terminal impedance of that open line is not the impedance of the sky wave, but is still fairly high, so that the cut at the input is equivalent to a short circuit enabling the wave to be transmitted to pass with a practically negligible attenuation; whereas the low-frequency interferences flow directly to ground, the antenna then acting as a lightning conductor with respect to the equipment units.

Another object of the invention is to produce a protection device of slight bulk by the incorporation of the decoupling circuit in the equipotentiality circuit, this being made possible by the equality of length, namely the quarter of the wave-length to be transmitted from one of the branches of the equipotentiality of the T connection from that of the decoupling circuit.

The above and the other objects of the present invention will become more clearly apparent from the following non-limiting description of a few embodiments of the invention, taken in connection with the accompanying drawings, in which.

Figure 1:
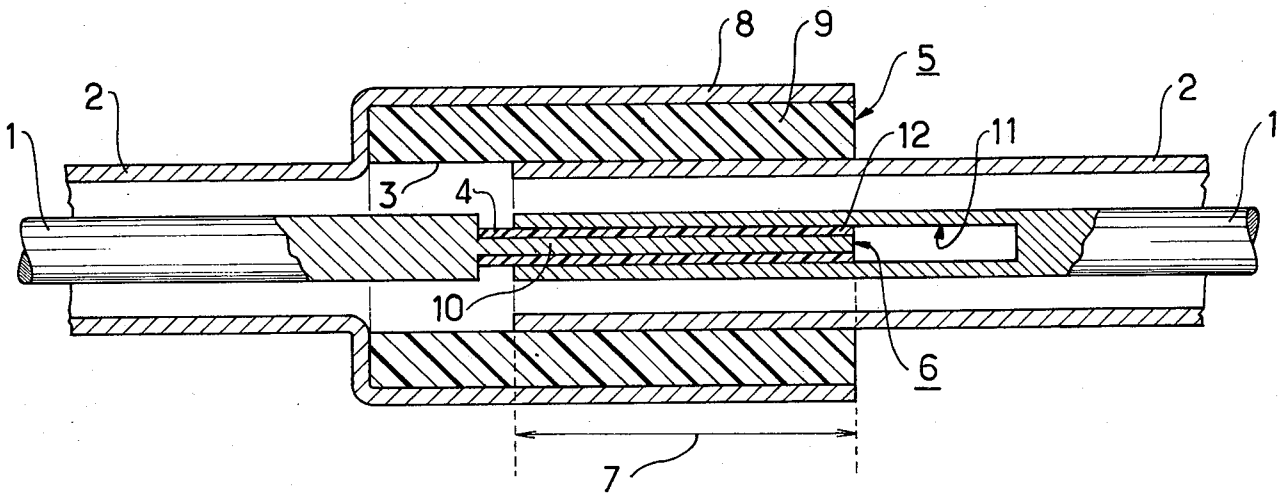
FIG. 1 is a diagrammatic axial cutaway view of a quarter-wave double trap and open for a coaxial cable according to the invention.

In FIG. 1, a coaxial line with a core 1 and external conductor 2 comprises, at the level of its two conductors, respectively the external cut 3 and the internal cut 4 on whose edges are connected in series the coaxial lines 5 and 6 respectively having the same length 7 equal to a quarter of the average transmission wavelength, the external coaxial line 5 being open and formed by the external conductor 8 surrounding the conductor 2 which acts as its internal conductor and between which is inserted the insulator 9. The internal coaxial line 6 comprises the internal conductor 10, the extension of the core 1, but having a smaller diameter, whereas the external conductor is formed by the periphery of the portion of the core 1 situated on the other side of the cut 4 and in which the cavity 11 has been formed. The insulator 12 is inserted between the conductors of the coaxial line 6.

Figure 2:
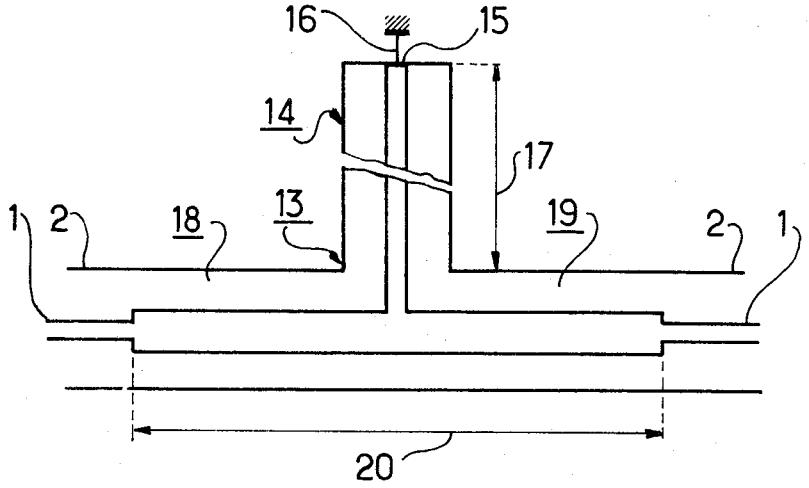
FIG. 2 is an equipotentiality T connection.

In FIG. 2, the coaxial cable having core 1 and conductor 2 is provided with its equipotentiality circuit or T connection 13 enabling the connection between two of the said conductors 1 and 2 for the looping of the high-voltage direct current while allowing the passing of the high-frequency signals to be transmitted. The equipotentiality T connection 13 comprises a coaxial line 14 connected in parallel to the main coaxial cable and whose end 15 is grounded at 16 and has a length 17 equal to a quarter of the operation wavelength. For optimum operation, the lateral arms 18 and 19 of the T connection 13 have a length equal to a quarter of the wavelength to be transmitted, that is, a sum 20 equal to half a wavelength, whereas their impedance is less by about twenty percent than that of the main coaxial line.

Figure 3:
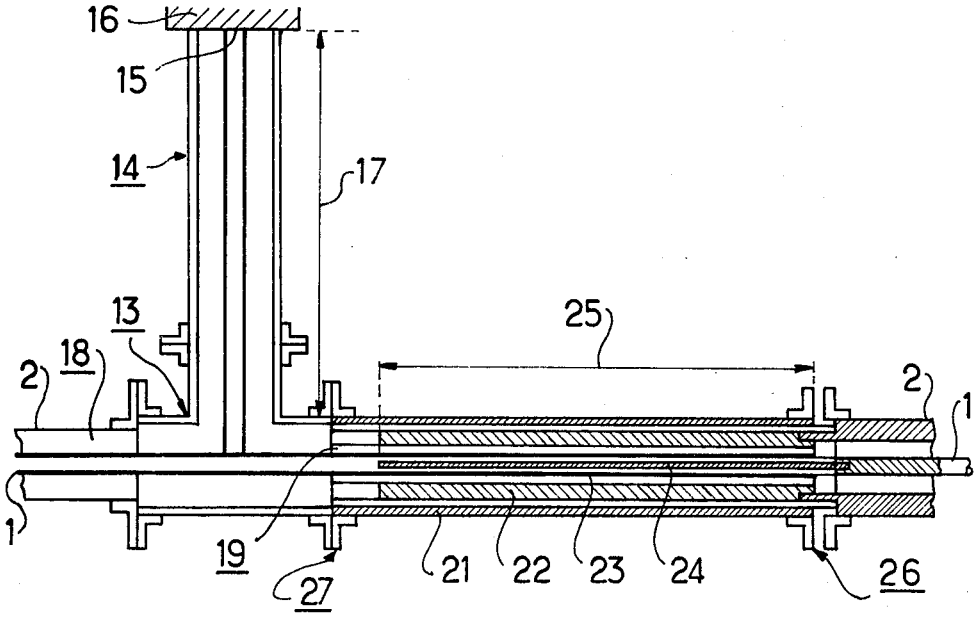
FIG. 3 is a diagrammatic cutaway view of a protection device, having an equipotentiality T connection and an incorporated decoupling circuit.

In FIG. 3, is shown a coaxial cable with a core 1 and external conductor 2. The cable is providedwith a protection device protecting against electrical discharges. The cable comprises the equipotentiality T-connection 13 with shunt line 14. In arm 19, the decoupling circuit 25, having the same length and equal to a quarter of the wavelength, has been incorporated. The conductors 22 and 23 constitute the coaxial line of the branch 19 of the T connection 13. The external trap of the decoupling is formed by the conductors 21 and 22 and the internal trap is formed by the conductors 23 and 24. The connector 26 insures the connection between the main coaxial cable and the decoupling circuit whereas the connector 27 connects the corresponding elements of the decoupling circuit to the arm 18 of the T connection 13 and to the line 14.

Figure 4:
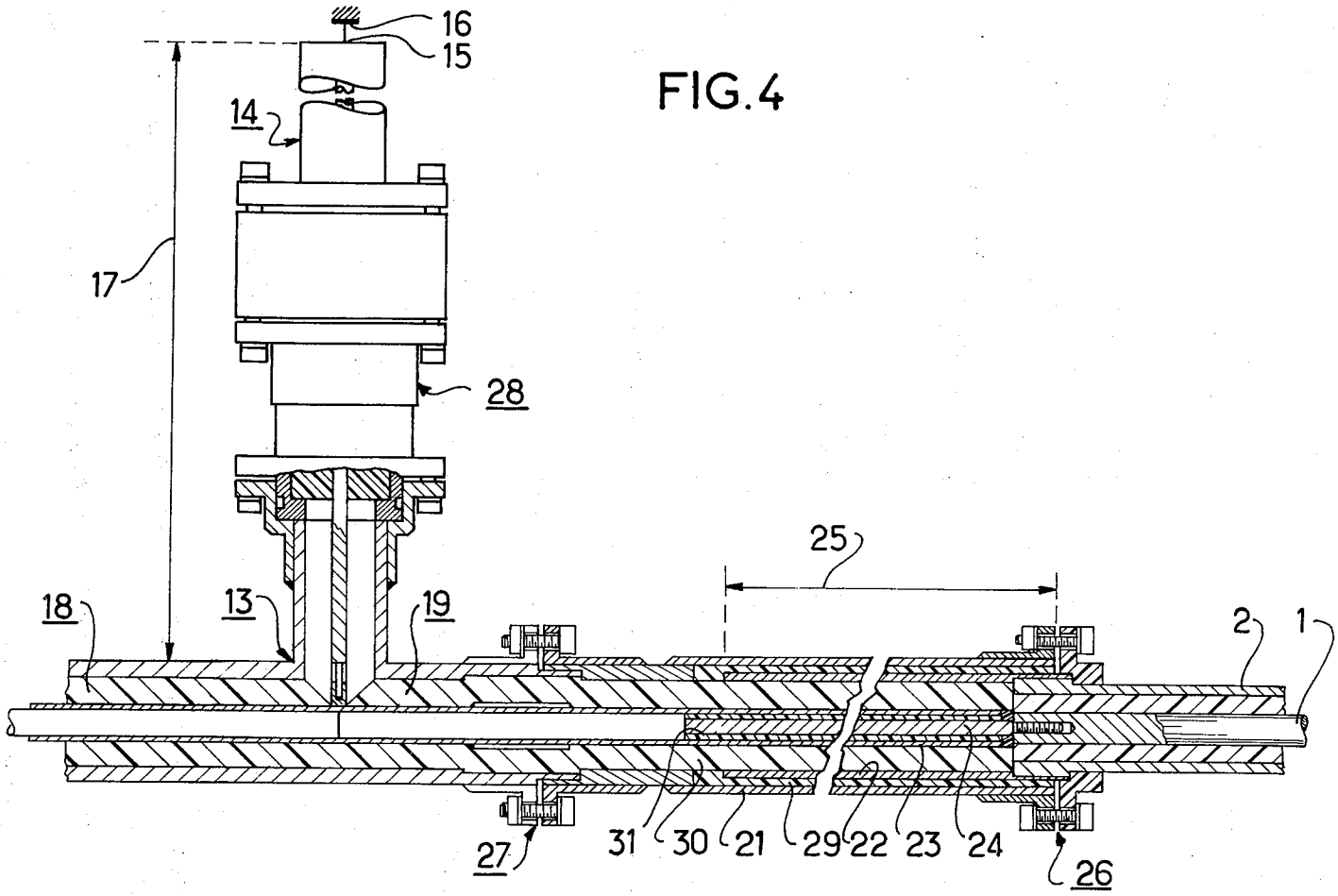
FIG. 4 is an embodiment according to the principle in FIG. 3 of a protection device having rigid components.

In FIG. 4, the decoupling circuit comprises the four rigid coaxial conductors 21, 22, 23 and 24 forming the three coaxial lines, with insulators 29 for the external trap, 30 for the arm 19 of the equipotentiality T connection 13, and 31 for the internal trap. In the case of a frequency of 10 megacycles to be transmitted, the length 25, representing a quarter of the wavelength, is equal to seven and one-half meters in the air. Hence on account of the existence of the insulator, this makes an even slighter wavelength and represents a substantial economy in relation to a half-wave trap closed at the end, which would require 15 meters in the air. Inasmuch as concerns the impedances of the various elements of the T connection 13, that which is characteristic of the shunt line 14 is 100 ohms; that of its branches 18 and 19 is equal to 40 ohms; those of the traps are respectively equivalent to 5 ohms for the external trap and 10 ohms for the internal trap, whereas the impedance of the coaxial cable to be protected is 50 ohms. The connector 28 insures the connecting of the line 14 to the T-connection 13 whose arm 19 is connected by the connector 27 to the protection device having two traps having the shape described and itself being connected to the main coaxial cable by the connector 26.

Figures 5, 6:
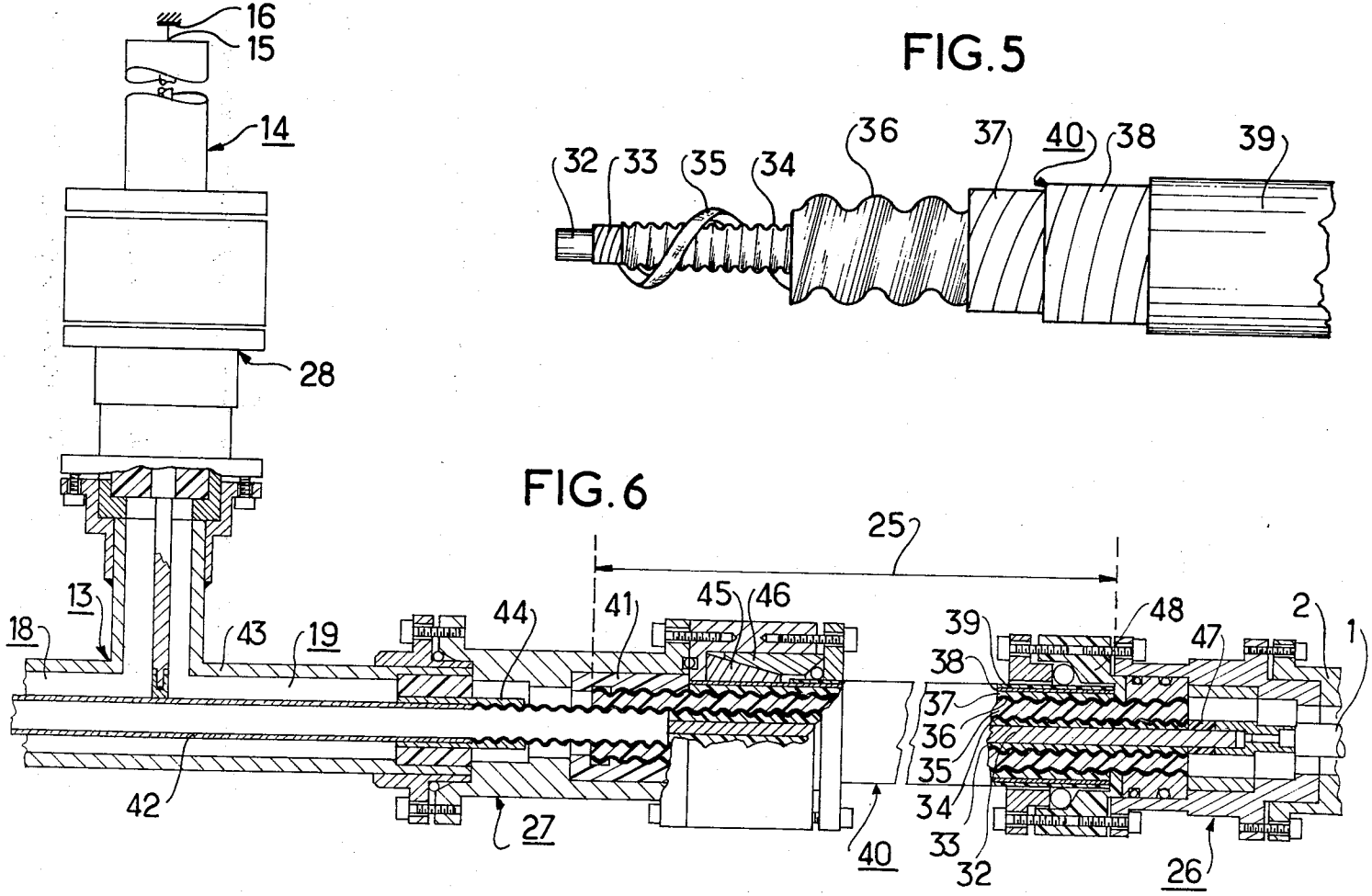
FIG. 5 is a triple coaxial cable for a decoupling circuit.
FIG. 6 is an embodiment of the protection device according to FIG. 3, with a triple coaxial cable decoupling circuit.

In FIG. 5, the cable 40 comprises four conductors, namely the central conductor 32, the splined conductors 34 and 36 and a metal sheet 38, between which are inserted the three insulants 33 made of teflon tape, 35 made of a helically wound polyethylene strip and 37 made of teflon tape; whereas a polyethylene casing 39 insures the mechanical protection of the said cable with respect to the outside.

From that triple coaxial cable 40, which is resilient, the three equipotentiality and decoupling functions insured by the rigid parts in FIG. 4 may be formed. It is necessary only to determine the dimensions of the cable so as to obtain the characteristics provided for, in such a way that the internal trap formed by the internal coaxial line having conductors 32 and 34 have an insulant 33 with a slight thickness inserted between them so as to obtain an impedance in the order of 10 ohms or so, the equipotentiality arm, formed by the middle coaxial line having conductors 34 and 36, have an insulating strip 35 suitable for insuring an impedance in the order of about 40 ohms and the external trap formed by the external coaxial line having conductors 36 and 38, by means of the thin inserted insulator 37, have an impedance in the order of 5 ohms.

In FIG. 6, the cable 40 is arranged, for the setting up of the required connections, between the connectors 26 and 27. Its length 25 is taken as equal to a quarter of the wavelength to be transmitted and the said connections are such that the decoupling circuit having two traps are open at its opposite end at each cut and connected in series between the arm 19 of the equipotentiality T-connection 13 and the main coaxial cable to be protected. For that purpose, the connector 26 insures the connection between the conductor 32 and the conductor 36 of the cable 40 respectively with the conductors 1 and 2 of the main coaxial cable, whereas the connector 27 insures, on the one hand, the insulating of the conductor 36 in relation to the T-connection, by means of the insulating part 41, bearing against its end. On the other hand, the insulating of the conductor 32 is placed facing the hollow conductor 42 of the arm 19. Likewise, the connector 27 insures the connecting of the conductors 34 and 38 of the cable 40 with the respective conductors 42 and 43 of the arm 19 of the T connection 13 by metallic clamping parts 44 and by the cone 45 connected with the ring 46, whereas the insulating thereof at the other end, in the connector 26, is insured respectively by the insulating distance piece 47 and by the insulating yoke 48.

The triple coaxial cable 40 has an attenuation equivalent to that of the coaxial cable insuring the connection, which is to be protected and hence effectively brings about an insignificant increase in attenuation whereas its threedecibel pass band is wider by several octaves than that obtained in embodiments having localized constants. Moreover, the bulk and the weight of the device, with the decoupling circuit in the form of a triple coaxial cable, hardly exceeds that of the cable itself and dispenses with the use of machined parts, which are then limited to the few necessary connection parts.

It is quite evident that these examples have no exhaustive character for the invention, which aims at protecting all variants corresponding to the general definition which has been given.

Thus, the triple coaxial cable can comprise in the manufacturing thereof both conductors and insulants of various shapes and of materials other than those set forth. More particularly, the external coaxial line forming the external trap of the decoupling circuit may, to great advantage, comprise a conductive thermoretractable casing to form the external conductor.

It must be understood that, to provide good protection when the distance between the antenna and the equipment units is great with respect to the wavelength of the useful signal or, even, to prevent a high current from running through the coaxial connection cable, a device according to the invention may be arranged at each end of the protection cable.

We claim:

1. A device providing double protection for a coaxial transmission line having two conductors, said device comprising two circuits, one of said circuits being connected in parallel to said line for equipotentiality and being formed by a T-connection including arms equal to one quarter of the wavelength to be transmitted, the other of said circuits being connected in series to said line for decoupling the line from spurious low frequencies, both of said circuits having parameters for providing high frequency coupling in said line, the decoupling circuit being integrated into one of said arms of said equipotentiality circuit, a cut being provided in each of the conductors of said transmission line for connection with said circuits, the decoupling circuit being a quarter-wave line having an open end and connected in series with each of said conductors of said coaxial transmission line.

2. A device according to claim 1, said line being a coaxial cable comprising four coaxial conductors between which are respectively located three dielectric substances whose thickness contributes to the obtaining of the impedances determined for the three coaxial lines

3. A device providing double protection for a coaxial transmission line, according to claim 1, comprising a portion of triple coaxial cable inserted between two connectors so that three coaxial lines having a length equal to a quarter of the wave length to be transmitted are constituted, the middle coaxial line forming one of the arms of the equipotentiality T-connection, the two other coaxial lines forming the decoupling circuit.

* * * * *